US008294050B2

(12) United States Patent
Murali et al.

(10) Patent No.: US 8,294,050 B2
(45) Date of Patent: Oct. 23, 2012

(54) LIMIT SWITCH ASSEMBLY

(75) Inventors: Deepak Murali, Karnataka (IN); Phaneendra Govindasetty Tirumani, Karnataka (IN)

(73) Assignee: Honeywell International Inc., Morristown, NJ (US)

( * ) Notice: Subject to any disclaimer, the term of this patent is extended or adjusted under 35 U.S.C. 154(b) by 302 days.

(21) Appl. No.: 12/793,135

(22) Filed: Jun. 3, 2010

(65) Prior Publication Data

US 2011/0297516 A1 Dec. 8, 2011

(51) Int. Cl.
*H01H 3/16* (2006.01)

(52) U.S. Cl. ..... 200/47

(58) Field of Classification Search ..... 200/47
See application file for complete search history.

(56) References Cited

U.S. PATENT DOCUMENTS

| | | | |
|---|---|---|---|
| 598,033 | A | 1/1898 | Stout, Jr. |
| 780,860 | A | 1/1905 | Brusseau |
| 1,656,952 | A | 1/1928 | Nutt |
| 1,833,948 | A | 12/1931 | Lansing |
| 1,846,513 | A | 2/1932 | Douglas |
| 2,255,706 | A | 9/1941 | Height |
| 2,671,140 | A | 3/1954 | Schellman |
| 2,899,511 | A | 8/1959 | Fraser |
| 3,222,485 | A | 12/1965 | Hardesty et al. |
| 3,694,595 | A | 9/1972 | Horecky |
| 4,345,128 | A | 8/1982 | Buttner et al. |
| 4,459,441 | A | 7/1984 | Hermle et al. |
| 4,924,040 | A | 5/1990 | Orrico |
| 5,682,978 | A | 11/1997 | Kawase |
| 6,518,528 | B2 | 2/2003 | Nickerson et al. |
| 6,576,854 | B2 | 6/2003 | Yamanaka et al. |
| 6,622,963 | B1 | 9/2003 | Ahrendt et al. |
| 2011/0073420 | A1* | 3/2011 | Nagel ..... 188/152 |

* cited by examiner

*Primary Examiner* — Vanessa Girardi
(74) *Attorney, Agent, or Firm* — Ingrassia Fisher & Lorenz, P.C.

(57) ABSTRACT

A limit switch assembly includes a housing having a first end, a second end, an inner surface that defines an inner volume and a spring engagement surface, and an outer surface. A limit switch disposed within the inner volume includes a threaded bushing section at least partially extending from the first end. A spring within the inner volume surrounds the bushing section, and engages the limit switch and the spring engagement surface. A calibration nut threaded onto the bushing section engages the first end of the housing. A seal divides the inner volume of the housing into a first volume and a second volume. A drain hole formed in the housing fluidly communicates the first volume to a surrounding environment. A terminal assembly connected to the second end of the housing seals the second volume from the surrounding environment.

16 Claims, 3 Drawing Sheets

LIMIT SWITCH ASSEMBLY

TECHNICAL FIELD

The present invention generally relates to switches, and more particularly relates to an improved limit switch assembly.

BACKGROUND

Limit switches are used in numerous systems and environments. For example, some thrust reverser actuation systems include limit switches to provide electrical control signals to command opening and closing of engine nacelle cowls. These existing switch designs include a limit switch that is disposed within a switch housing, and that extends through a cover, and a pair of hexagonal nuts and a pair of tab washers. The cover is provided with a grub screw, which is used, in conjunction with the hexagonal nuts, to calibrate the switch. The cover is fastened to one end of the housing with screws, and the other end of the housing is fastened to a flange also via screws. An O-ring is disposed between the housing and the flange. A connector is fastened to the flange, and another O-ring is disposed between the flange and the connector. Before fastening the connector the entire switch is potted with epoxy.

Although existing limit switch assemblies, such as the one described above, are generally safe, reliable, and robust, these switch assemblies can exhibit certain drawbacks. For example, existing limit switch assemblies can have water stagnate within the switch housing. Also, the time it takes to calibrate the limit switches can be relatively time consuming, and the number of parts that comprise the limit switches can be relatively high. Together, these latter two drawbacks can lead to increased overall costs.

Hence there is a need for a limit switch assembly that is less likely to accumulate stagnating water and/or can be calibrated relatively quickly and/or comprises relatively less number of parts. The instant invention addresses one or more of these needs.

BRIEF SUMMARY

In one embodiment, a limit switch assembly includes a housing, a limit switch, a spring, and a calibration nut. The housing has a first end, a second end, an inner surface, and an outer surface. The inner surface defines an inner volume and a spring engagement surface. The limit switch is disposed within the inner volume of the housing. The limit switch includes a bushing section having a plurality of threads formed on at least a portion thereof, and at least partially extends from the first end of the housing. The spring is disposed within the inner volume of the housing and surrounds the bushing section. The spring engages the limit switch and the spring engagement surface. The calibration nut is threaded onto the bushing section and engages the first end of the housing.

In another embodiment, a limit switch assembly includes a housing, a limit switch, a seal, a drain hole, and a terminal assembly. The housing has a first end, a second end, an inner surface, and an outer surface. The inner surface defines an inner volume. The limit switch is disposed within the inner volume of the housing, and includes a bushing section at least partially extending from the first end of the housing. The seal is disposed between and engages the inner surface of the housing and a portion of the limit switch, and divides the inner volume of the housing into a first volume and a second volume. The drain hole is formed in the housing and extends between the inner and outer surfaces. The drain hole fluidly communicates the first volume to a surrounding environment. The terminal assembly is connected to the second end of the housing to seal the second volume from the surrounding environment.

In yet another embodiment, a limit switch assembly includes a housing, a limit switch, a spring, a calibration nut, a seal, a drain hole, and a terminal assembly. The housing has a first end, a second end, an inner surface, and an outer surface. The inner surface defines an inner volume and a spring engagement surface. The limit switch is disposed within the inner volume of the housing. The limit switch includes a bushing section having a plurality of threads formed on at least a portion thereof. The bushing section at least partially extends from the first end of the housing. The spring is disposed within the inner volume of the housing and surrounds the bushing section. The spring engages the limit switch and the spring engagement surface. The calibration nut is threaded onto the bushing section of the limit switch and engages the first end of the housing. The seal is disposed between and engages the inner surface of the housing and a portion of the limit switch, and divides the inner volume of the housing into a first volume and a second volume. The drain hole is formed in the housing and extends between the inner and outer surfaces. The drain hole fluidly communicates the first volume to a surrounding environment. The terminal assembly is connected to the second end of the housing to seal the second volume from the surrounding environment.

Furthermore, other desirable features and characteristics of the limit switch assembly will become apparent from the subsequent detailed description, taken in conjunction with the accompanying drawings and this background.

BRIEF DESCRIPTION OF THE DRAWINGS

The present invention will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

Figure 1:
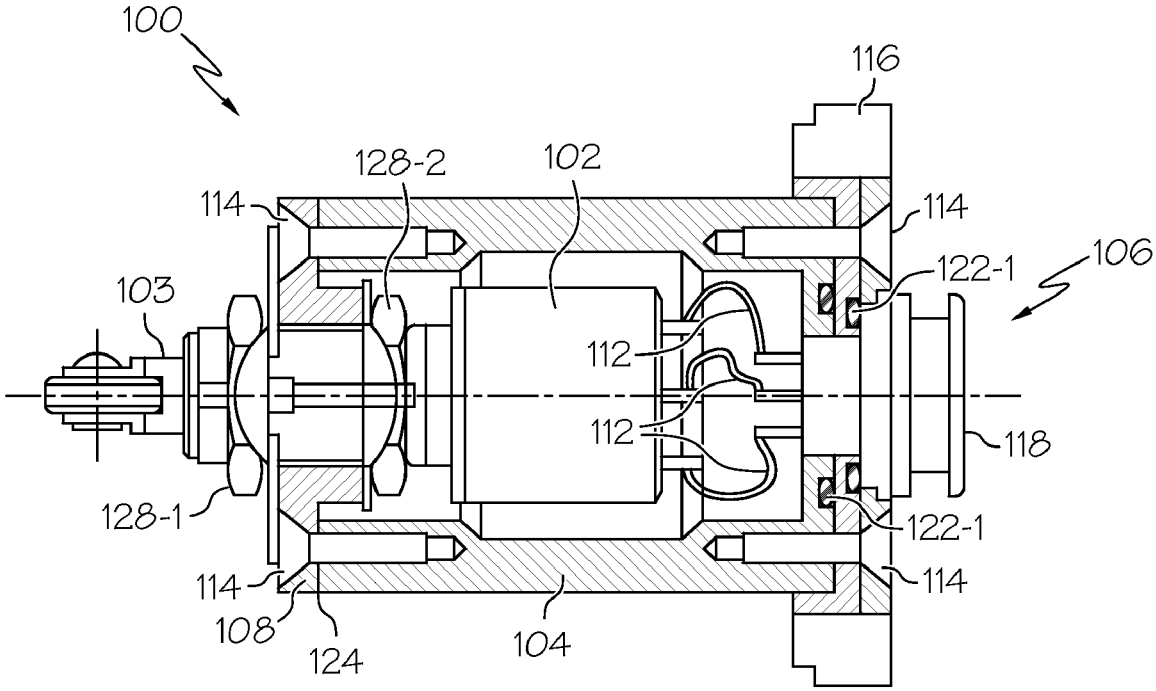
FIG. 1 (PRIOR ART)
FIG. 1 depicts a cross section view of a known limit switch assembly.

A cross section view of a known limit switch assembly is depicted in FIG. 1. The known limit switch assembly 100 includes a limit switch 102, a switch housing 104, a terminal assembly 106, and a housing cover 108. The limit switch 102 is disposed within the switch housing 104 and has a bushing section 103 that extends through the housing cover 108. The limit switch 102 is also electrically connected, via a plurality of wires 112, to the terminal assembly 106.

The terminal assembly 106 is fastened to one end of the switch housing 104 via a plurality of fasteners 114, and includes a flange 116, a connector 118, and a plurality of O-ring seals 122. The connector 118 extends through an opening in the flange 116, with one of the O-rings 122-1 disposed between the connector 118 and the flange 116. The other O-ring seal 122-1 is disposed between the switch housing 104 and the flange 116.

The housing cover 108 and an intervening seal gasket 124 are fastened to the other end of the switch housing 104 using a plurality of fasteners 114. The limit switch 102 is secured to and positioned with respect to the housing cover 108 via a plurality of retainer nuts 128. One of the nuts 128-1 is disposed on one side of the housing cover 108 and outside of the switch housing 104. The other nut 128-2 is disposed on the other side of the housing cover 108 and within the switch housing 104. It may thus be appreciated that at least a portion of the bushing section 103 has mating threads formed thereon. As shown more clearly in FIG. 2, a tab washer 132 is disposed between each retainer nut 128 and the housing cover 108.

Figure 2:
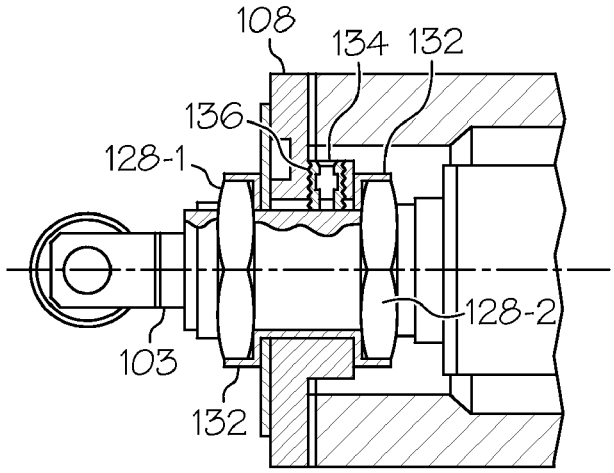
FIG. 2 (PRIOR ART)
FIG. 2 depicts a close-up cross section view of the known limit switch assembly depicted in FIG. 1.

With continued reference to FIG. 2, it is seen that the housing cover 108 includes a grub screw opening 134, through which a grub screw 136 extends. The grub screw 136 is used, together with the retainer nuts 128, to calibrate the limit switch 102. In particular, the limit switch 102 is calibrated by (sometimes repeatedly) loosening one of the retainer nuts 128 and tightening the other, and then locking the limit switch 102 with respect to the housing cover 108 using the grub screw 136. As may be appreciated, this can be a relatively time consuming process.

Figure 3:
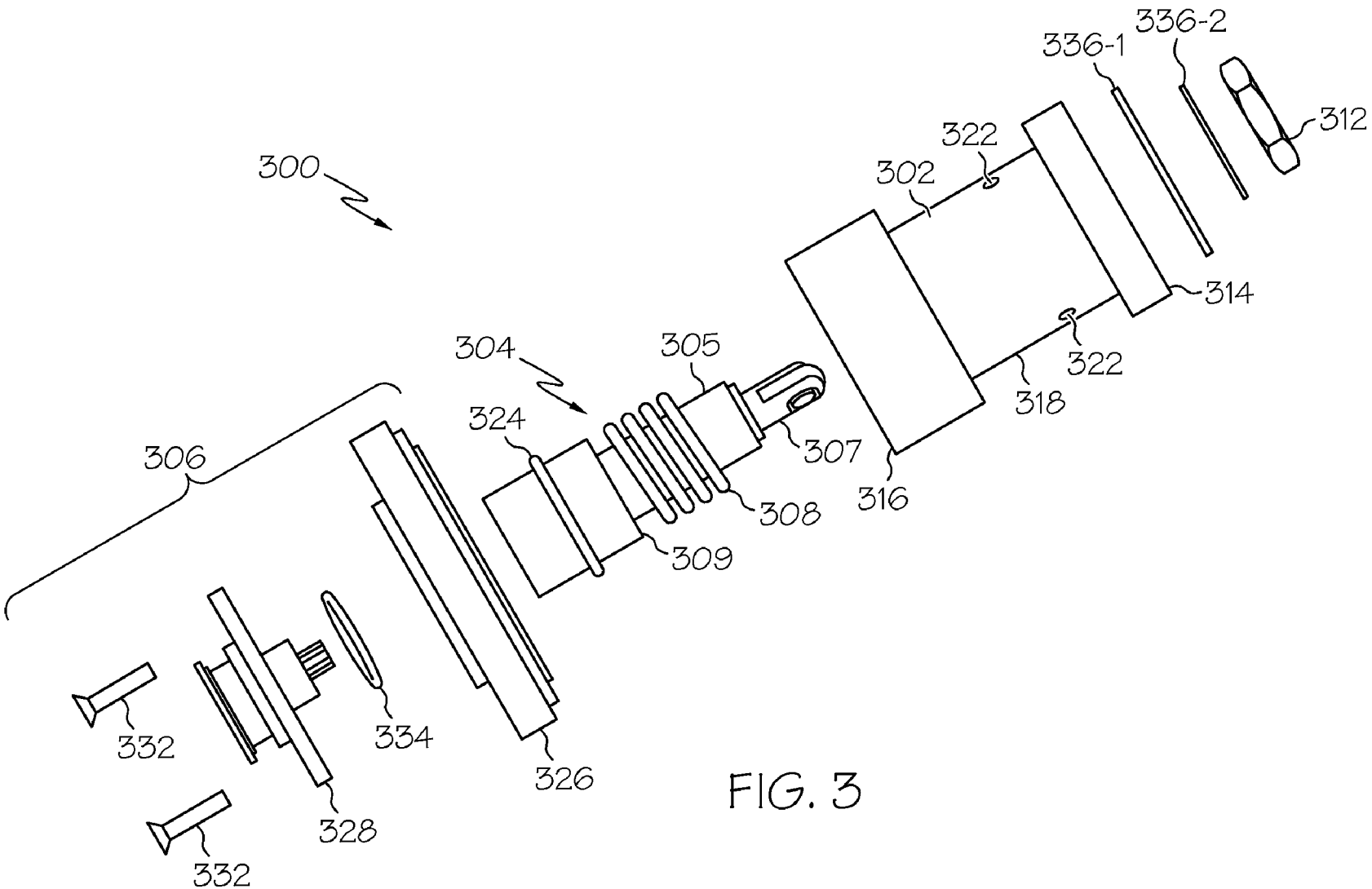
FIG. 3 depicts an exploded view of an improved limit switch assembly according to an embodiment of the present invention.
Figure 4:
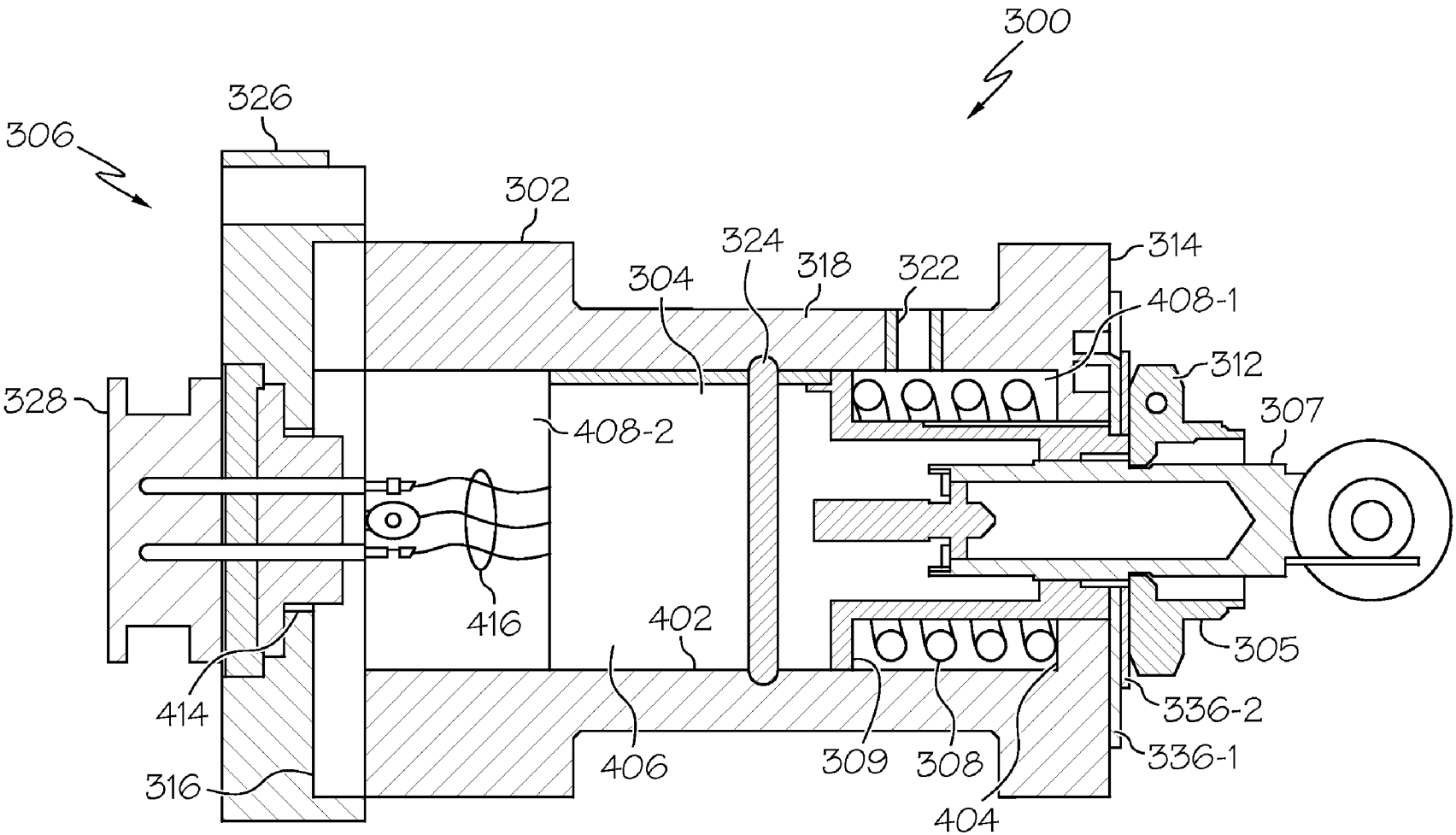
FIG. 4 depicts a cross section view of the improved limit switch assembly depicted in FIG. 3.

Turning now to FIGS. 3 and 4, an exploded view and a cross section view, respectively, of an exemplary embodiment of an improved limit switch assembly 300 is depicted. The limit switch assembly 300 includes a housing 302, a limit switch 304, a terminal assembly 306, a spring 308, and a calibration nut 312. The housing 302 has a first end 314, a second end 316, an inner surface 402 (see FIG. 4), and an outer surface 318. The inner surface 402 defines a spring engagement surface 404, and an inner volume 406 within which the limit switch 304 and spring 308 are disposed.

The housing 302 also has a plurality of drain holes 322 formed therein that extend between the housing inner surface 402 and the housing outer surface 318. The drain holes 322 allow any moisture that may form in the housing 302 to drain, thereby preventing, or at least inhibiting, moisture accumulation with the housing 302. It will be appreciated that the number of drain holes 322 that are formed in the housing 302 may vary. Moreover, although the housing 302 preferably includes a plurality of drain holes 322, it will be appreciated that the housing 302 could be implemented with one drain hole 322, if needed or desired.

The limit switch 304 includes a bushing section 305. The bushing section 305 has a plurality of threads formed on at least a portion thereof, and at least partially extends from the first end 314 of the housing 302. The limit switch 304 may be implemented using any one of numerous types of limit switches and limit switch technologies now known or developed in the future. Preferably, however, the limit switch 304 is configured with the bushing section 305, and includes an actuator portion 307 that is axially movable relative to the bushing section 305. The actuator portion 307 is used, in response to its axial movement, to selectively actuate a non-illustrated switch mechanism.

A seal 324 is disposed between and engages the inner surface 402 of the housing 302 and a portion of the limit switch 304. The seal 324 thus divides the inner volume 406 of the housing 302 into a first volume 408-1 and a second volume 408-2. It should be noted that the drain holes 322 are formed at a location in the housing 302, and the seal 324 is disposed at a location on the limit switch 304, such that the drain holes 322 fluidly communicate the first volume 408-1 to the environment 412 surrounding the limit switch assembly 300. The second volume 408-2, however, is sealed from the surrounding environment 412 by the terminal assembly 306.

The terminal assembly 306 is connected to the second end 316 of the housing 302, and includes a flange 326 and a connector 328. The flange 326 has an opening 414 (see FIG. 4) extending therethrough, and is connected to the second end 316 of the housing 302 preferably via a welding process. The connector 328 is coupled to the flange 326, preferably via a plurality of fasteners 332, and extends through the flange opening 414. A plurality of wires 416 electrically couples the connector 328 to the limit switch 304. A second seal 334, such as the depicted O-ring seal, is preferably disposed between the flange 326 and the connector 328. Moreover, though not depicted, the second volume 408-2 may also be filled with a suitable potting material, such as epoxy resin.

The spring 308, as noted above, is also disposed within the inner volume 406 of the housing 302, and additionally surrounds the bushing section 305 of the limit switch 304. One end of the spring 308 engages the limit switch 304, and more specifically a ledge 309 formed on the bushing section 305 of the limit switch 304. The other end of the spring 308 engages the spring engagement surface 404. As will now be described, the spring 308 is used, in conjunction with the calibration nut 312, to calibrate the limit switch 304.

The calibration nut 312 is threaded onto the bushing section 305 of the limit switch 304 and, via a plurality of intervening tab washers 336 (336-1, 336-2), engages the first end 314 of the housing 302. With the configuration of the housing 302, the limit switch bushing section 305, and the spring 308, it may be readily appreciated that when the calibration nut 312 is rotated in one direction, the limit switch 304 will be moved toward the first end 314 of the housing 302, and increase the compression of the spring 308. Conversely, when the calibration nut 312 is rotated in the opposite direction, the limit switch 304 will move away from the first end 314 of the housing 302, and decrease the compression of the spring 308.

The limit switch assembly described herein is implemented with less parts than presently known limit switch assemblies, such as the one depicted in FIGS. 1 and 2 and described above. Hence, the overall cost of the limit switch assembly is relatively less than those presently known. The configuration of the limit switch assembly prevents, or at least inhibits, moisture accumulation within the housing, and facilitates relatively quick and easy assembly, and relatively quick and easy calibration.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A limit switch assembly, comprising:

a housing having a first end, a second end, an inner surface, and an outer surface, the inner surface defining an inner volume and a spring engagement surface;

a limit switch disposed within the inner volume of the housing, the limit switch including a bushing section having a plurality of threads formed on at least a portion thereof, the bushing section at least partially extending from the first end of the housing;

a spring disposed within the inner volume of the housing and surrounding the bushing section, the spring engaging the limit switch and the spring engagement surface; and a calibration nut threaded onto the bushing section of the limit switch and engaging the first end of the housing.

2. The limit switch assembly of claim 1, wherein the calibration nut and the bushing section of the limit switch are configured such that:

rotation of the calibration nut in a first direction moves the limit switch toward the first end of the housing, and thereby increasing compression of the spring; and rotation of the calibration nut in a second direction moves the limit switch away from the first end of the housing, and thereby decreasing the compression of the spring.

3. The limit switch assembly of claim 1, further comprising:

a tab washer disposed between the calibration nut and the first end of the housing.

4. The limit switch assembly of claim 1, further comprising:

a seal disposed between and engaging the inner surface of the housing and a portion of the limit switch, the seal dividing the inner volume of the housing into a first volume and a second volume;

a drain hole formed in the housing and extending between the inner and outer surfaces, the drain hole fluidly communicating the first volume to a surrounding environment; and a terminal assembly connected to the second end of the housing to seal the second volume from the surrounding environment.

5. The limit switch assembly of claim 4, wherein the terminal assembly comprises:

a flange connected to the second end of the housing and having an opening extending therethrough;

a connector coupled to the flange and extending through the opening, the connector electrically coupled to the limit switch.

6. The limit switch assembly of claim 5, further comprising:

a seal disposed between and engaging the flange and the connector; and a plurality of fasteners coupling the connector to the flange.

7. A limit switch assembly, comprising:

a housing having a first end, a second end, an inner surface, and an outer surface, the inner surface defining an inner volume;

a limit switch disposed within the inner volume of the housing, the limit switch including a bushing section at least partially extending from the first end of the housing;

a first seal disposed between and engaging the inner surface of the housing and a portion of the limit switch, the seal dividing the inner volume of the housing into a first volume and a second volume;

a drain hole formed in the housing and extending between the inner and outer surfaces, the drain hole fluidly communicating the first volume to a surrounding environment;

a terminal assembly connected to the second end of the housing to seal the second volume from the surrounding environment;

a flange connected to the second end of the housing and having an opening extending therethrough;

a connector coupled to the flange and extending through the opening, the connector electrically coupled to the limit switch;

a second seal disposed between and engaging the flange and the connector; and a plurality of fasteners coupling the connector to the flange.

8. The limit switch assembly of claim 7, further comprising:

a tab washer disposed between calibration nut and the first end of the housing.

9. The limit switch assembly of claim 7, further comprising:

a plurality of threads formed on at least a portion of the bushing section; and a calibration nut threaded onto the bushing section and engaging the first end of the housing.

10. The limit switch assembly of claim 9, wherein:

the housing inner surface additionally defines a spring engagement surface; and the limit switch assembly further comprises a spring disposed within the inner volume of the housing and surrounding the bushing section, the spring engaging the limit switch and the spring engagement surface.

11. The limit switch assembly of claim 10, wherein the calibration nut and the bushing section of the limit switch are configured such that:

rotation of the calibration nut in a first direction moves the limit switch toward the first end of the housing, and thereby increasing compression of the spring; and rotation of the calibration nut in a second direction moves the limit switch away from the first end of the housing, and thereby decreasing the compression of the spring.

12. A limit switch assembly, comprising:

a housing having a first end, a second end, an inner surface, and an outer surface, the inner surface defining an inner volume and a spring engagement surface;

a limit switch disposed within the inner volume of the housing, the limit switch including a bushing section having a plurality of threads formed on at least a portion thereof, the bushing section at least partially extending from the first end of the housing;

a spring disposed within the inner volume of the housing and surrounding the bushing section, the spring engaging the limit switch and the spring engagement surface;

a calibration nut threaded onto the bushing section of the limit switch and engaging the first end of the housing;

a seal disposed between and engaging the inner surface of the housing and a portion of the limit switch, the seal dividing the inner volume of the housing into a first volume and a second volume;

a drain hole formed in the housing and extending between the inner and outer surfaces, the drain hole fluidly communicating the first volume to a surrounding environment; and a terminal assembly connected to the second end of the housing to seal the second volume from the surrounding environment.

13. The limit switch assembly of claim 12, further comprising:

a tab washer disposed between the calibration nut and the first end of the housing.

14. The limit switch assembly of claim 12, wherein the calibration nut and the bushing section of the limit switch are configured such that:

rotation of the calibration nut in a first direction moves the limit switch toward the first end of the housing, and thereby increasing compression of the spring; and rotation of the calibration nut in a second direction moves the limit switch away from the first end of the housing, and thereby decreasing the compression of the spring.

15. The limit switch assembly of claim 12, wherein the terminal assembly comprises:

a flange connected to the second end of the housing and having an opening extending therethrough;

a connector coupled to the flange and extending through the opening, the connector electrically coupled to the limit switch.

16. The limit switch assembly of claim 15, further comprising:

a seal disposed between and engaging the flange and the connector; and a plurality of fasteners coupling the connector to the flange.

* * * * *